United States Patent [19]

Grace et al.

[11] Patent Number: 4,655,024

[45] Date of Patent: Apr. 7, 1987

[54] PRECONSTRUCTED BUILDING STRUCTURES AND METHOD OF CONSTRUCTION AND ASSEMBLY

[75] Inventors: Edward M. Grace, Hyattsville, Md.; Robert E. Phillips, Pensacola, Fla.

[73] Assignee: Grace Building Systems, Inc., Hyattsville, Md.

[21] Appl. No.: 553,014

[22] Filed: Nov. 18, 1983

[51] Int. Cl.[4] ..... E04G 21/00; B32B 31/00

[52] U.S. Cl. ..... 52/745; 52/309.8; 156/278; 156/289

[58] Field of Search ..... 52/309.3, 309.7, 309.8, 52/309.9, 583, 587, 741-743, 745-747, 749, 750; 156/278, 289; 264/338; 249/115

[56] References Cited

U.S. PATENT DOCUMENTS

| | | | |
|---|---|---|---|
| 2,525,204 | 10/1950 | Calabro | 52/749 |
| 2,704,935 | 3/1955 | Uddenborg | 52/375 |
| 3,327,442 | 6/1967 | Hermann | 52/309.16 |
| 3,413,188 | 11/1968 | Allen | 428/481 |
| 3,427,178 | 2/1969 | Zakim et al. | 249/115 |
| 3,450,593 | 6/1969 | Fossier et al. | 428/73 |
| 3,579,937 | 5/1971 | Lukens | 52/309.7 |
| 3,598,686 | 8/1971 | Clark | 52/309.7 |
| 3,872,640 | 3/1975 | Megumi | 52/605 |
| 3,885,008 | 5/1975 | Martin | 264/45.3 |
| 3,965,635 | 6/1976 | Renkert | 52/309.7 |
| 4,068,431 | 1/1978 | Pitt | 52/204 |
| 4,078,343 | 3/1978 | Rothman | 52/583 |
| 4,118,203 | 10/1978 | Beardmore et al. | 264/338 |
| 4,185,437 | 1/1980 | Robinson | 52/601 |
| 4,399,088 | 8/1983 | Greene | 249/115 |

FOREIGN PATENT DOCUMENTS

| | | | |
|---|---|---|---|
| 852465 | 9/1970 | Canada | 52/745 |
| 2063191 | 7/1971 | France | 52/309.8 |
| 2501103 | 9/1982 | France | 264/338 |
| 45-23386 | 8/1970 | Japan | 249/115 |
| 55-86749 | 6/1980 | Japan | 156/278 |

*Primary Examiner*—John E. Murtagh
*Assistant Examiner*—Andrew Joseph Rudy
*Attorney, Agent, or Firm*—John E. Benoit

[57] ABSTRACT

A process for constructing a building by forming a plurality of individual panels with each panel being of a length and height so as to constitute one wall or one roof section of the building, securing studding in a predetermined pattern to each of said individual panels, and assembling the insulated panels together in situ so as to construct a building having walls and a roof. Further, a means is provided for forming the wall of an insulated panel with the placement of studding in a predetermined pattern with said studding being laminated to the panel so as to form the basic wall structure.

5 Claims, 10 Drawing Figures

FIG. 1
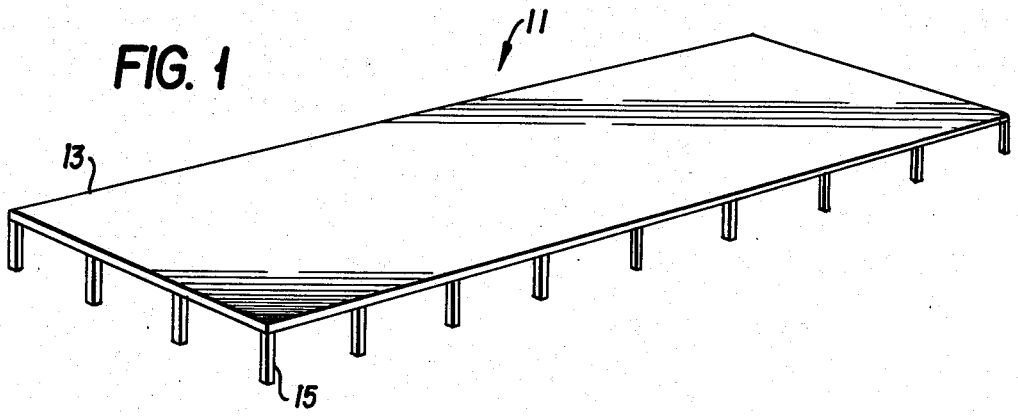
FIG. 2
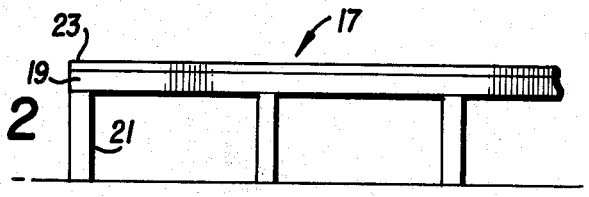
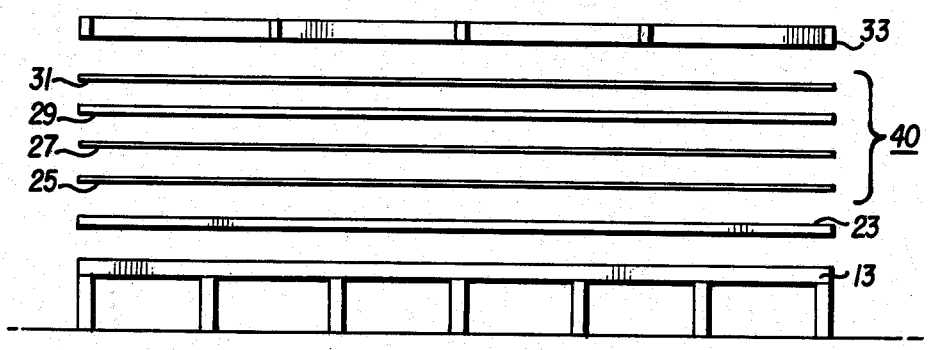
FIG. 3
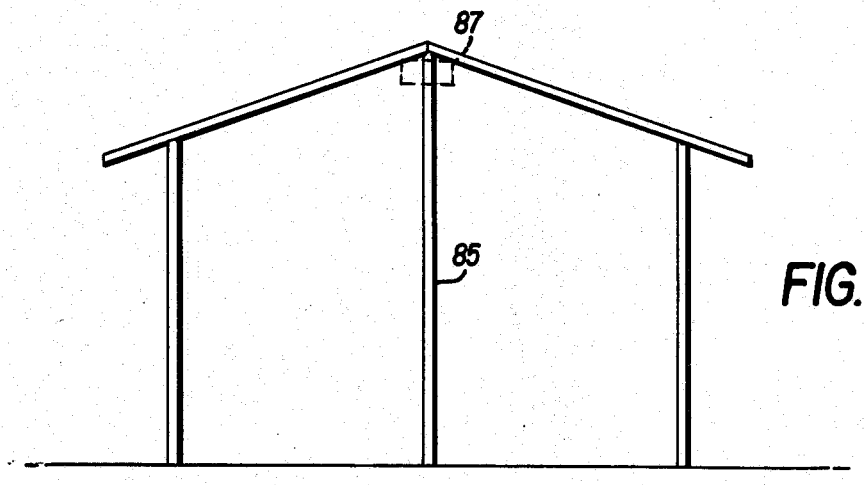
FIG. 10

FIG. 4
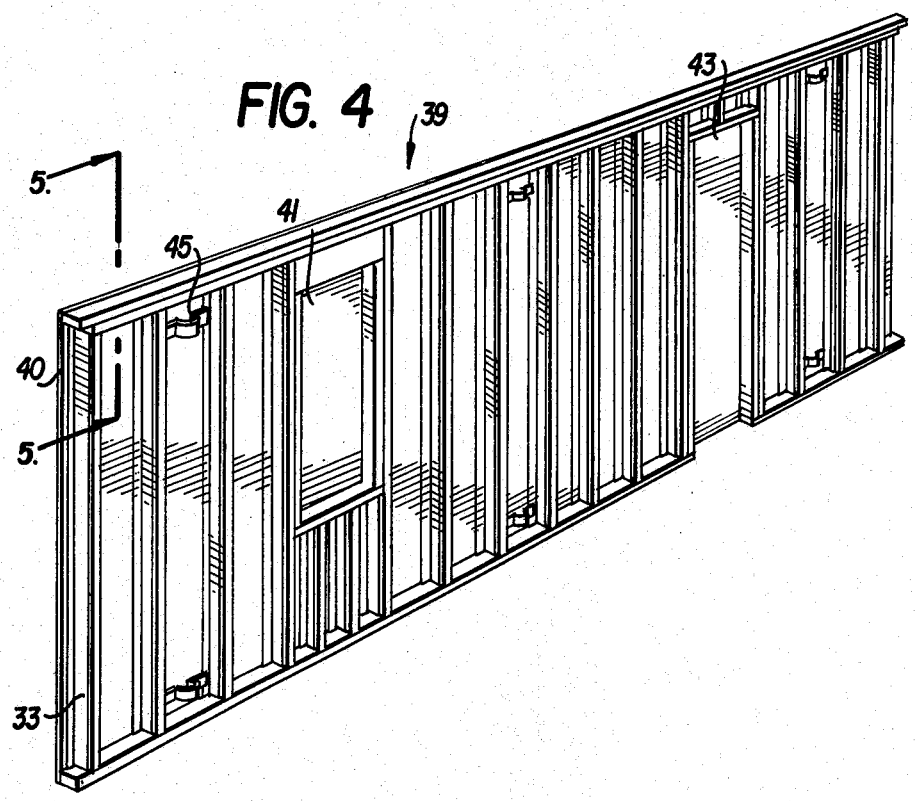
FIG. 5
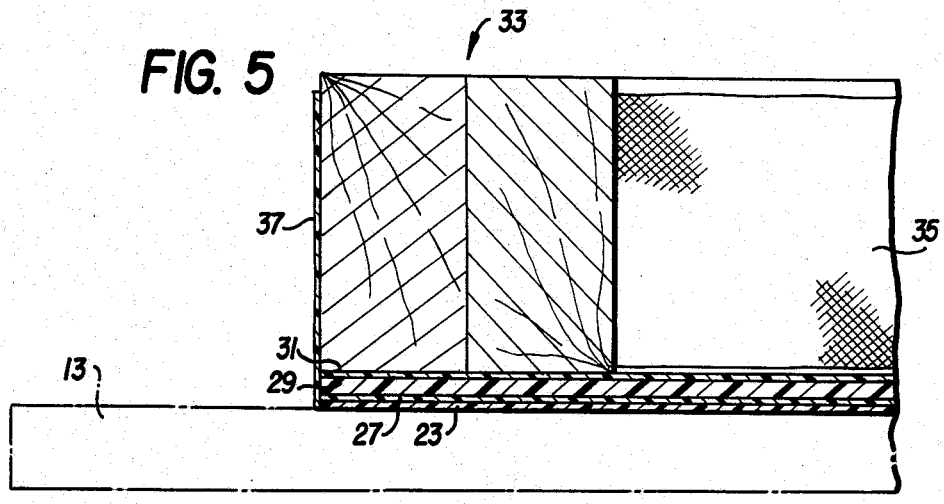
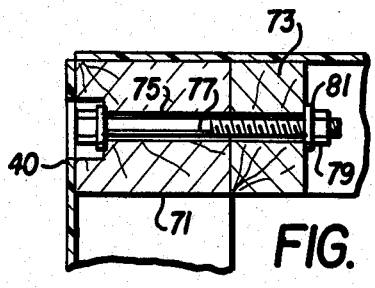
FIG. 8
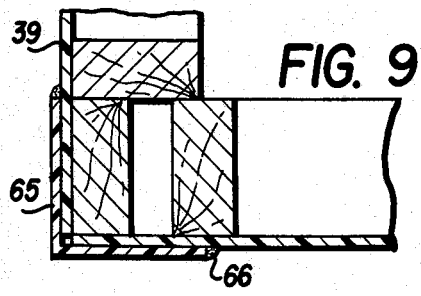
FIG. 9

PRECONSTRUCTED BUILDING STRUCTURES AND METHOD OF CONSTRUCTION AND ASSEMBLY

This application relates generally to building construction and more specifically to a building construction which permits preconstruction of the entire walls of the building as well as separate roof sections whereby the basic element may be quickly and easily assembled at the site location.

Many efforts have been made in the past and are continally being made in order to provide a simplified construction for a basic house. This type of house is in great need in many of the poor sections of our country and particularly in the developing countries of the third world.

Past efforts have included basic construction of panels such as 8-foot panels, shipping the panels to the site of the home and proceeding with the standard type of construction for using such panels to build a house.

Other efforts include the concept of building a home which is then severed into sections, such as half sections, and shipping these sections to the site for the homes to be built.

The former, relating to the building of individual sectional panels, requires that considerable amount of labor and time must be expended at the home site in order to complete the construction of the house. Additionally, the roof must be built after the panels are in place.

The latter conception, that is the building of the house and subsequently sectionalizing it and transporting it to the site where the parts are again placed together and secured together, requires unusual shipping conditions and limits the use of this type of construction to areas which have access to major highways, railroads or the like.

Accordingly, it is an object of the present invention to preconstruct the walls and the roof sections of a basic four-sided house. These sections may then be easily transported to the site of the home construction and secured together so as to form a house.

A further object of the invention is to provide the above-identified walls with insulated panels which are laminated to the studding.

Yet another object of this invention is to provide preconstructed wall and roofing members which may be easily transported and easily and quickly assembled at the building site.

A further object of the invention is to provide preconstructed wall and roofing members which may be assembled, disassembled and reassembled.

A still further object of this invention is to provide a process for constructing a basic wall or roof of a building, such as a house, wherein the panel is of an insulated nature and the studding may be applied to the panel in any predetermined arrangement and laminated thereto whereby doors and windows may be cut in the walls either before or after the panels are in the building area.

These and other object of the invention will become obvious from the following description taken in conjunction with the drawings.

BRIEF DESCRIPTION OF THE DRAWINGS

FIG. 1 is a perspective view of a proposed mold table on which the building structure is assembled;

FIG. 2 is a schematic partial view of a table which is used to form the master mold;

FIG. 3 is a schematic representation showing the process of constructing the building structure of the present invention;

FIG. 4 discloses a completed structure which comprises one entire wall of a building;

FIG. 5 is a sectional view taken through the lines 5—5 of FIG. 4;

FIG. 8 is a partial sectional view showing a preferred means of securing the individual structures to each other;

FIG. 9 is a partial sectional view showing one means of sealing the structural members at the joints thereof; and FIG. 10 is a schematic illustration of an internal supporting structure used with the building elements of FIG. 7.

SUMMARY OF THE INVENTION

Figure 6:
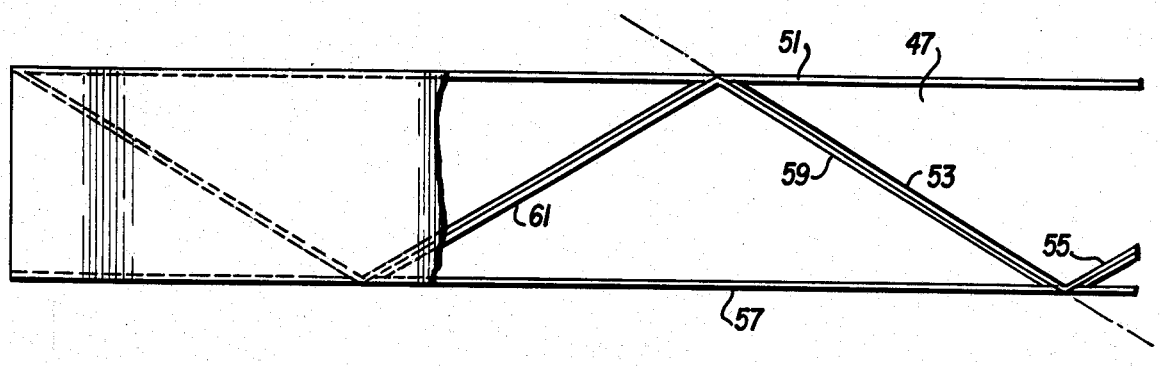
FIG. 6 is a schematic illustration of the construction of gables for use in the building structure.

The present invention relates to a process for constructing a building by forming a plurality of individual panels with each panel being of a length and height so as to constitute one wall or one roof section of the building, securing studding in a predetermined pattern to each of said individual panels, and assembling the insulated panels together in situ so as to construct a building having walls and a roof. The invention also relates to a means for forming the wall of an insulated panel with the placement of studding in a predetermined pattern with said studding being laminated to the panel so as to form the basic wall structure.

DETAILED DESCRIPTION OF A PREFERRED EMBODIMENT

Turning now to FIG. 1, there is shown a mold table 11 having a flat surface 13 and leg 15. For structural strength, it is preferred that this table be constructed of metal or the like. In practice, this table is constructed at a sufficient length so that a surface area will be available for different sizes of building structures as will become apparent as the description proceeds.

FIG. 2 is a partial sectional view of a master table 17 which includes a master surface 19 supported by legs 21. The table could be a frame structure as well as the angle flat surface. The master surface is selected so as to give the exterior of the building a texture which enhances the appearance over and above a flat plastic appearance. Such a master table may be made of cedar or the like so that the finally constructed house will give the appearance of being of a wooden contruction. It is understood that the material used as discussed hereinafter can be made of any color, such as a simulation of cedar.

In order to make the master mold which is to be placed on mold table 11, the surface of the table 19 is coated with a wax and then sprayed with a fiberglass resin over the waxed wood to obtain the desired thickness. This is then removed from table 19 and is trimmed to the desired size. This creates the master mold which is then turned over and secured to the mold table 11.

FIG. 3 is a schematic representation of the process of the present invention which is used to provide the completed wall sections. It is to be understood that the thicknesses shown for each section are not representative since they will vary considerably but are only shown so as to clearly provide a representation of the process.

After surface 23 is properly secured to mold table 11, it is sprayed with gel coating 25 to the desired thickness, such as 15±2 mils, and allowed to dry. The next step is to spray the surface area which is determined to meet the requirements of the walls or roof structures to be constructed with a fire-retardant polyester resin mixed with strands of fiberglass by means of a spray device such as a chopper gun. This coating is applied to the desired thickness such as 1½ ounces per square foot over the dry gelcoat.

A core 29, such as a PVC foam panel or the like of the desired thickness, such as ¼ or ½ inch, is cut to the size, length and width of the wall, soaked with resin, and placed on the reinforced fiberglass layer. Although this can be done at any time, it is preferably done while the layer is still wet.

Core 29 is then sprayed with a further coating 31 of the resin reinforced fiberglass to the desired thickness, such as 1½ ounces per square foot. Thus, panel 40, as indicated in FIG. 3, is completed.

Dimensions of the wall having been determined, the studding may then be layed upon coating 31 in the desired configuration including positioning of the future site of doors and windows. It is to be understood that the studding can be wood, metal or plastic. After the studding is in place so as to create the framework, it is then laminated to panel 40 by securing means, one of which will be discussed as the description proceeds.

The entire structure is then cured so that it thoroughly bonds the stud structure to the panel. As will be evident, this process creates a one-piece unit which cannot be pulled apart at any point or layer.

FIGS. 4 and 5 are illustrative of finished wall structure 39 incorporating panel 40. As can be seen, a provision has been made therein for window 41 and door 43. FIG. 5 illustrates one means for securing the stud structure to finished panel 40. As can be seen, fiberglass laminates 35 and 37 comprising a cloth such as a 24 ounce cloth sprayed with resin and a hardner are positioned adjacent the panel and the studding. This is allowed to cure so as to solidly secure the stud structure to panel 40. In order to provide means for lifting the panel from the mold table, straps 45 may also be formed of similar cloth sprayed with resin which then is cured so as to be securely attached to the panel 40. Thus, a crane or the like may be used to hook onto straps 40 and remove the structure from the table and also to erect the structure in the field.

Although the mold table could be made wide enough so as to accommodate a gable structure at the top of the walls wherein such gables normally exist, it is preferable to use a separate table in order to form these gables to simplify construction and reduce transportation problems. Such a structure is shown schematically in FIG. 6 wherein the panels are constructed as stated above and the studding structure including frame members 51, 53, 55, 59, and 61 are placed on the panel and secured thereto as in the manner discussed above. After the structure has cured, it may be separated by means such as by sawing through the lines as indicated by the dash lines in FIG. 6. As will be appreciated, this will provide the gables which are necessary in a basic house structure.

Turning to the basic house structure of FIG. 7, it can be seen that wall panels 39 as produced by the process discussed hereinabove are placed together in situ as are gables 47 and roof panels 63 (only one of which has been shown).

Figure 7:
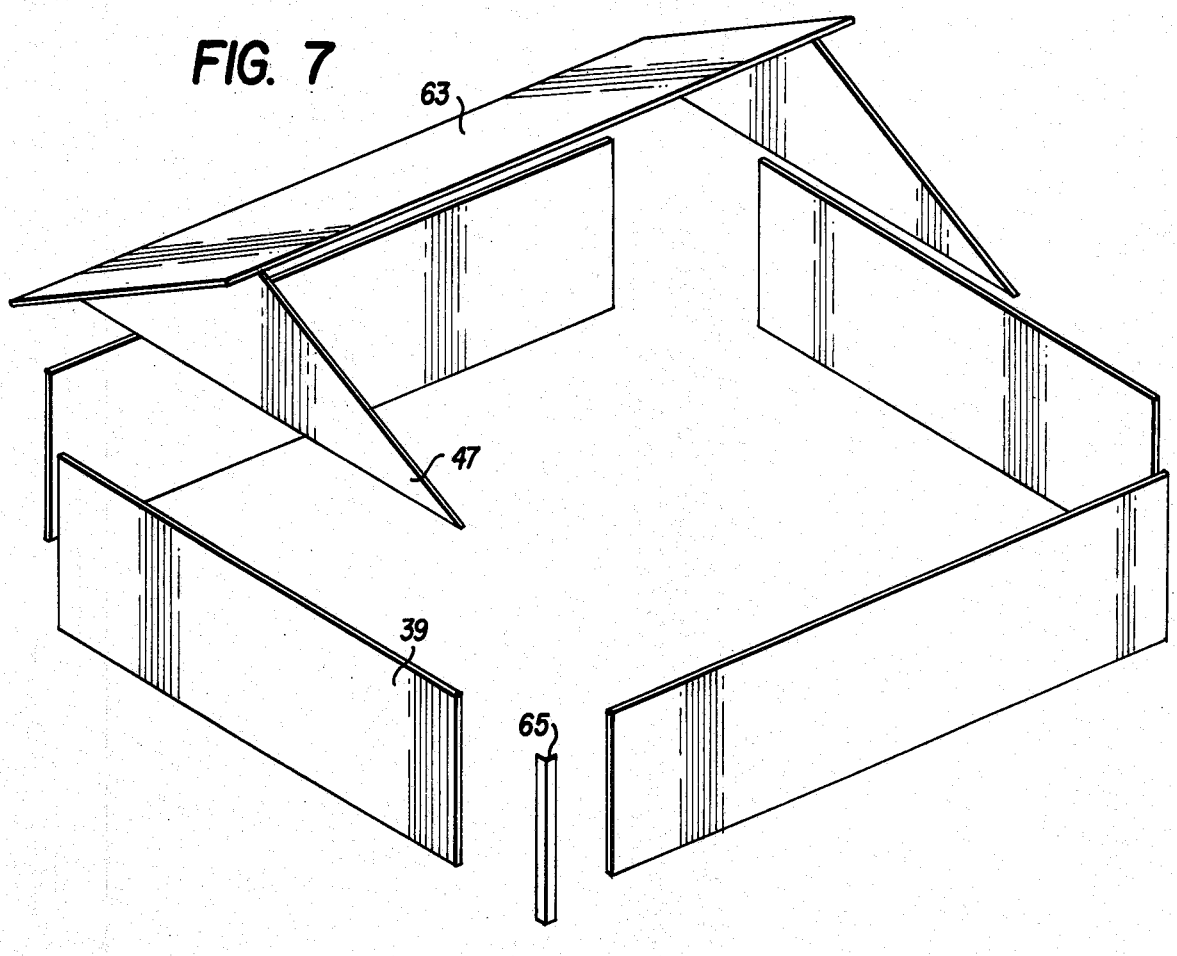
FIG. 7 is a schematic representation showing the method of constructing the building at the site.

FIG. 8 shows a simple and preferred manner in which the various structures of FIG. 7 may be secured together. In this particular method, a bore hole 75, which is countersunk, is drilled through adjoining stud members, and a bolt 77 is passed therethrough and secured by means of nut 79 and washer 81. Thus, stud member 71 and 73 are securely fastened together. This same structure may be used relative to securing the gables and the roofing as determined by the placing of the frame members while the roofing members are being built.

FIG. 9 discloses one means whereby the joints can be sealed where the various structures are secured together. In this case, a right angle section of paneling such as that used for the basic wall structure is placed against the corner structure and is secured thereto by means of caulking 66 and the like. It is to be understood that any sealing means could be used.

FIG. 10 illustrates two means for supplying a central support for the basic housing unit. In this illustration, two roof sections are shown although the number of sections may vary for specific requirements. Preferably, a main partition 85 extends the length of the house and supports the two roofing members at their apex. Alternately, a girder 87, shown in dotted lines may also be used in the standard manner.

Once the basic shell of the house is in place, the interior may be finished as desired using any partition design as may be required.

This type of housing construction is very economical and is quickly assembled and disassembled, and may be transported relatively easily to more remote areas in nearly any part of the world. It may be built on any solid base such as a concrete base or it may even be built on the ground itself where permissible.

When the foam panel construction as illustrated is used, the house provides substantial insulation against both cold and heat and, further, because of the plastic materials used, the structure and the pigmentation used almost never requires painting, and is not susceptible to the ravages of nature such as termites or corrosion or deterioration which is found in normal housing construction.

The above description and drawing are illustrative only since obvious substitutions could be made without departing from the invention which is to be limited only by the scope of the following claims.

We claim:

1. A method for constructing a unitary building structure consisting of the steps of (1) preparing a substantially flat master mold having a predetermined surface texture;

(2) spraying gel coat over said master mold;

(3) spraying a first layer of a fiberglass reinforced resin over said gel coat;

(4) laying a core of insulating material over said reinforced fiberglass;

(5) spraying a second layer of fiberglass reinforced resin over said core of insulating material whereby a panel is formed comprising said core and said layers of reinforced fiberglass;

(6) laying studding over said second layer of reinforced fiberglass in a predetermined framing configuration;

(7) laminating said studding to said layer of reinforced fiberglass;

(8) curing said panel and lamination;

(9) removing said structure from said mold; and

(10) securing four of said structures together at abutting edges so as to form four self-supporting load bearing walls of a building.

2. The method of claim 1 further consisting of the steps of securing a predetermined number of said structures together at abutting edges so as to form a roof for said structure; and securing said roof to said walls.

3. The method of claims 1 or 2 further consisting of the step of removing sections of said panel so as to form doors and windows in selected walls.

4. The method of claim 3 further consisting of the steps of cutting one of said structures so as to form gable sections; and securing said gable sections between said roof and said walls.

5. The method of claim 3 further consisting of the step of sealing said abutting edges of said walls.

* * * * *